US010903588B2

(12) United States Patent
Txarola et al.

(10) Patent No.: US 10,903,588 B2
(45) Date of Patent: Jan. 26, 2021

(54) DUAL CONTACT BENT IDCC HEADER PIN AND TWO-THICKNESS IDCC HEADER PIN

(71) Applicant: J.S.T. CORPORATION, Farmington Hills, MI (US)

(72) Inventors: Joseph Txarola, Farmington Hills, MI (US); Gwendolyn Upson, Ypsilanti, MI (US); Ping Chen, Novi, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 16/522,438

(22) Filed: Jul. 25, 2019

(65) Prior Publication Data

US 2020/0036108 A1 Jan. 30, 2020

Related U.S. Application Data

(60) Provisional application No. 62/702,988, filed on Jul. 25, 2018.

(51) Int. Cl.

| | |
|---|---|
| ***H01R 4/2425*** | (2018.01) |
| ***H01R 4/2429*** | (2018.01) |
| ***H01R 12/58*** | (2011.01) |
| ***H01R 13/50*** | (2006.01) |
| ***H01R 13/05*** | (2006.01) |
| ***H01R 13/11*** | (2006.01) |
| ***H01R 12/55*** | (2011.01) |

(52) U.S. Cl.

CPC ..... *H01R 4/2425* (2013.01); *H01R 4/2429* (2013.01); *H01R 12/55* (2013.01); *H01R 12/585* (2013.01); *H01R 13/05* (2013.01); *H01R 13/11* (2013.01); *H01R 13/50* (2013.01)

(58) Field of Classification Search

CPC .... H01R 4/2445; H01R 4/245; H01R 4/2454; H01R 12/585; H01R 9/092; H01R 4/2425; H01R 4/2429; H01R 12/55; H01R 13/50; H01R 13/05; H01R 13/11

USPC ..... 439/397, 401, 82, 751

See application file for complete search history.

(56) References Cited

U.S. PATENT DOCUMENTS

| | | | | |
|---|---|---|---|---|
| 4,043,628 A * | 8/1977 | Narozny | ..... | H01R 4/2458 439/397 |
| 4,538,872 A * | 9/1985 | Brubaker | ..... | H01R 4/2466 439/396 |
| 4,909,754 A * | 3/1990 | Paradis | ..... | H01R 4/2429 439/395 |
| 5,269,700 A * | 12/1993 | Mitra | ..... | H01R 4/245 439/395 |

(Continued)

*Primary Examiner* — Gary F Paumen

(74) *Attorney, Agent, or Firm* — Kratz, Quintos & Hanson, LLP

(57) ABSTRACT

Each IDCC header pin is comprised of an upper section, a pin barb section, and a lower section. Each IDCC header pin has at least a first pin barb on its pin barb section, to allow it to be anchored and retained into a housing. The upper section of each IDCC header pin also has a blade to contact a wire and displace the insulation thereof. The lower section of the pins has an associated compliant retention feature which allows the IDCC header pin to be retained into respective holes in a PCB. A dual contact bent IDCC header pin can include two upper sections which each have a blade and create a dual contact with a wire, and another embodiment can have a two-thickness upper section.

10 Claims, 11 Drawing Sheets

(56) References Cited

U.S. PATENT DOCUMENTS

| | | | | | |
|---|---|---|---|---|---|
| 5,616,047 | A * | 4/1997 | Lutsch | H01R 4/2466 | 439/395 |
| 5,645,445 | A * | 7/1997 | Siemon | H01R 4/2429 | 439/395 |
| 5,860,829 | A * | 1/1999 | Hower | H01R 4/2433 | 439/397 |
| 6,010,362 | A * | 1/2000 | Caviness | H01F 27/29 | 336/192 |
| 6,290,531 | B1 * | 9/2001 | Onizuka | H01R 4/2425 | 439/395 |
| 6,296,513 | B1 * | 10/2001 | Ishikawa | H01R 4/2454 | 439/397 |
| 7,118,404 | B2 * | 10/2006 | Ploesser | H01R 4/2454 | 439/398 |
| 8,708,733 | B2 * | 4/2014 | Parrish | H01R 4/242 | 439/395 |
| 2005/0272299 | A1 * | 12/2005 | Ploesser | H01R 4/2454 | 439/395 |
| 2018/0287277 | A1 * | 10/2018 | Lybrand | H01R 12/515 | |
| 2019/0131723 | A1 * | 5/2019 | Txarola | H01R 4/2429 | |
| 2020/0036109 | A1 * | 1/2020 | Txarola | H01R 12/55 | |

* cited by examiner

DUAL CONTACT BENT IDCC HEADER PIN AND TWO-THICKNESS IDCC HEADER PIN

CROSS-REFERENCE TO RELATED APPLICATIONS

This application claims priority of U.S. provisional application No. 62/702,988, filed Jul. 25, 2018.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention generally relates to the field of electrical connectors, which are useful in automotive applications, or the like.

2. Description of the Related Art

An insulation-displacement contact (IDC) is an electrical contact designed to be connected to the conductor(s) of an insulated cable by a connection process that forces a selectively sharpened blade or blades through the insulation, bypassing the need to strip the conductors of insulation before connecting. A compliant pin is a pin that adheres to a PCB through the application of normal force and interference fit. Insulation Displacement Contact Compliant header pins (IDCC header pins) are used in connector systems. In use, during an insertion process, the header pin is placed into a housing and secured, allowing the housing to then be attached to a circuit board using a compliant end, with no solder, and have wires (conductors) inserted into the blades thereof. In many examples of the related art, when IDCC pins are inserted into a housing, the securing of the header pins requires an additional component, such as a plastic cover or pronged terminal system.

Attempts to address this problem have been made. U.S. patent Ser. No. 16/174,825, entitled "IDCC CONNECTION SYSTEM AND PROCESS", Txarola et al. on Oct. 30, 2018, discloses an Insulation Displacement Contact Compliant (IDC) pin system, which includes a housing, header pins, and a printed circuit board (PCB). Each header pin has at least a single barb to be retained into the housing, a blade for contacting a wire, and a retention feature to retain itself into a PCB. The housing also has a negative space similarly shaped to the pin. When the system is fully assembled, the pins will reside in the housing, and exit through the housing and into and through respective holes in a PCB. A wire can then be inserted into the housing once the pin resides within, as well as several options for the assembly process including a) a pin-to-housing insertion process; b) a housing assembly-to-PCB process or a connector-to-PCB process; and c) a wired housing assembly-to-PCB assembly process or a wire harness-to-PCB assembly process.

Accordingly, there still exists a need for a more acceptable IDC pin capable of maintaining a connection with a wire while particularly being able to be secured into a housing without an additional component, such as a plastic cover or pronged terminal system. Many of the features of this invention are designed to ameliorate this problem.

BRIEF SUMMARY OF THE INVENTION

Each IDCC header pin is comprised of an upper section, a pin barb section, and a lower section. Each IDCC header pin has at least a first pin barb on its pin barb section, to allow it to be retained into a housing. The pin barbs anchor the header pin into a housing. The upper section of each IDCC header pin also has a blade to contact a wire and displace the insulation thereof. The lower section of the pins has an associated compliant retention feature which allows the IDCC header pin to be retained into respective holes in a PCB. A dual contact bent IDCC header pin can include two upper sections which each have a blade, and create a dual contact with a wire, and another embodiment can have a two-thickness upper section.

DETAILED DESCRIPTION OF THE PREFERRED EMBODIMENTS

Embodiment 1

Figure 1:
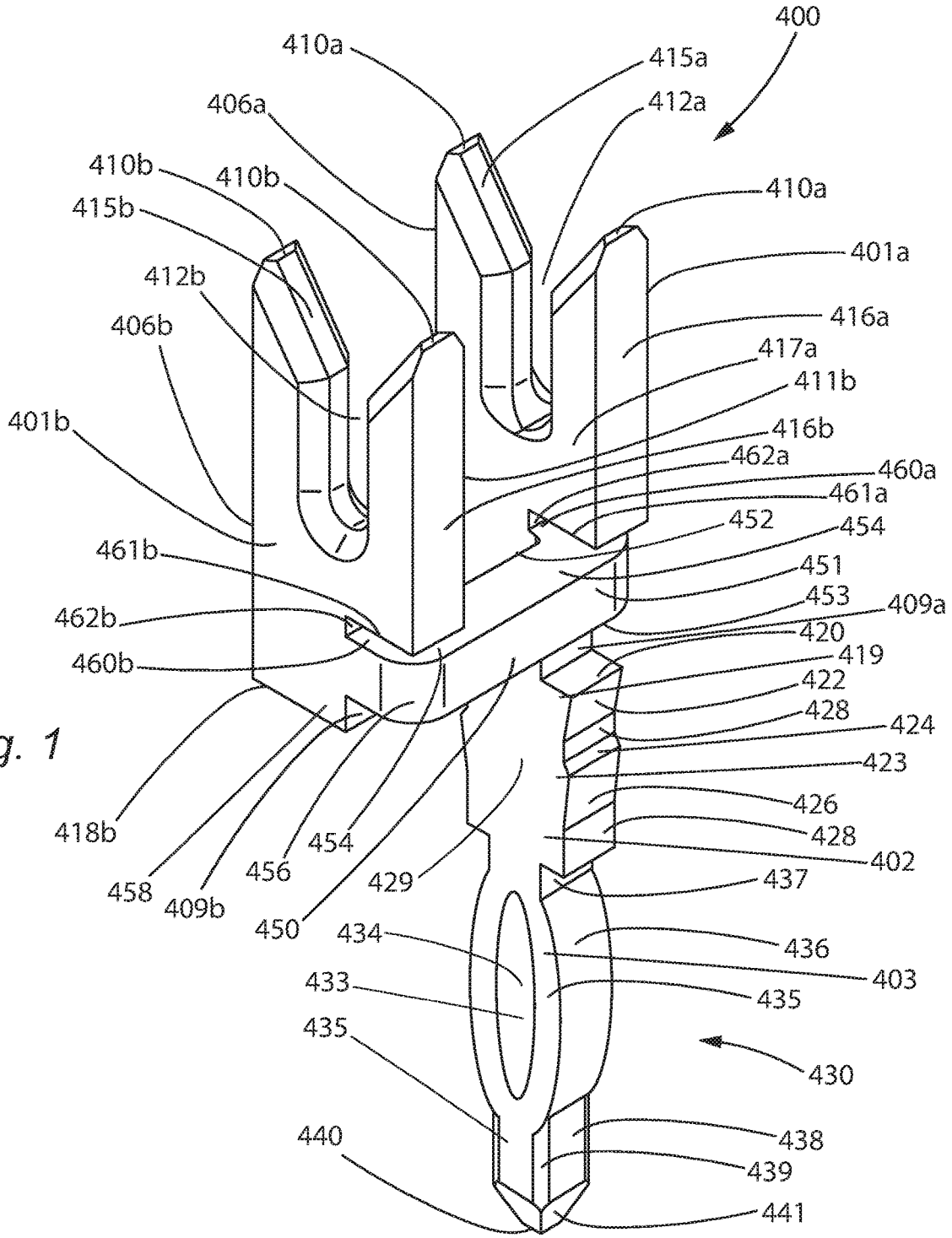
FIG. 1 is a perspective view of an embodiment of the dual contact bent IDCC header pin of the present invention.

As shown in FIG. 1, the dual contact bent IDCC header pin 400 can be considered to have a lengthwise direction, and can be considered to have four sections: a first upper section 401*a*, a second upper section 401*b*, a pin barb section 402, and a lower section 403. The first upper portion 401*a* and second upper portion 401*b* are generally parallel with the lengthwise direction of the pin 400 and have a uniform thickness (see FIG. 5). The first upper portion 401*a*, and second upper portion 401*b* may be mirror images of each other.

Figure 5:
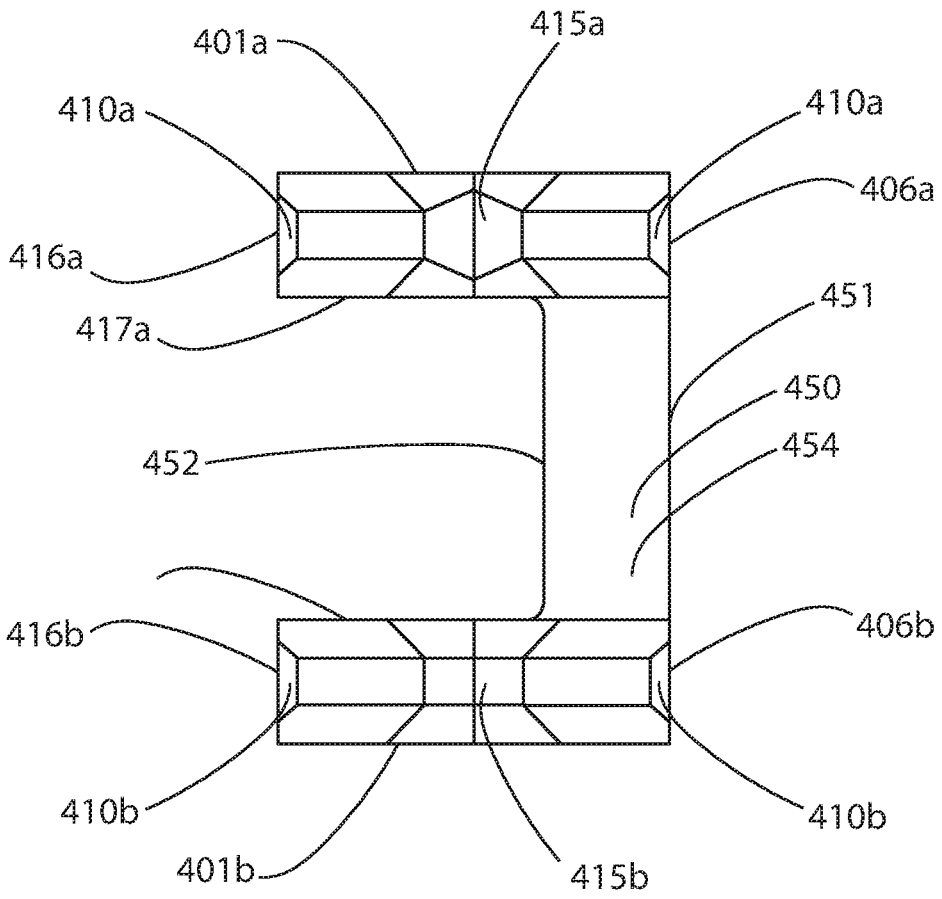
FIG. 5 is a top elevation view of an embodiment of the dual contact bent IDCC header pin of the present invention.

On the first 401*a* and second 401*b* upper section, at one end in the lengthwise direction of the IDCC header pin 400, are IDC flats 410*a*, 410*b*. As illustrated in FIGS. 1 and 5, IDC flats 410*a*, 410*b* include two flat regions perpendicular to the lengthwise direction of IDCC header pin 400 (also see FIGS. 2 and 3). The IDCC flats 410*a*, 410*b* are surfaces on which a machine/jig can apply force to the IDCC header pin 400 to insert it into a housing. Along the lengthwise direction of the first 401*a* and second 401*b* upper sections are upper first side 416*a*, 416*b*, and second side 406*a*, 406*b*, respectively. As illustrated in FIG. 1, the upper first sides 416*a*, 416*b*, and second sides 406*a*, 406*b* are generally parallel with the lengthwise direction of the pin. At the opposite end of the IDCC header pin 400 in the lengthwise direction, is IDCC header pin tip 440. The lower section 403 includes pin lead-in chamfers 441, which are angled to prevent stubbing of the header pin 400 when it is inserted into and through a housing or a hole in a printed circuit board.

In the first and second upper sections 401*a*, 401*b* below the IDCC flats 410*a*, 410*b*, are IDCC blades 415*a*, 415*b* respectively (see FIG. 1). IDC blades are known in the art and are capable of cutting into the wire jacket of a wire conductor to make non-damaging electrical contact with a wire conductor. As illustrated in FIG. 1, IDCC blades 415*a*, 415*b* are generally of a horseshoe shape with a gap 412*a*, 412*b* between each blade 415*a*, 415*b* respectively. The IDCC blades 415*a*, 415*b*, form a dual contact with a wire, contacting a wire in two locations.

As illustrated in FIGS. 1-5, in the first and second upper sections 401*a*, 401*b* below the blades 415*a*, 415*b*, is a bridge 450. The bridge 450 extends from the first upper portion 401*a* to the second upper portion 401*b*. The bridge 450 extends from the first upper portion 401*a* in a direction perpendicular from the front face 417*a* thereof, and perpendicular with respect to the lengthwise direction of the pin 400 (see FIG. 1). As shown in more detail in FIGS. 2 and 3, the bridge 450 connects the second upper portion 401*b* to the first upper portion 401*a*, in a direction perpendicular from the front face 417*a* towards the rear face 411*b* of the second upper portion 401*b*. The second upper portion 401*b* extends from the end 458 of the bridge 450, and as seen in more detail in FIG. 1 the second upper portion 401*b* is generally perpendicular to the bridge 450 and parallel with the first upper portion 401*a*. The rear face 411*b* of the second upper portion 401*b* faces the front face 417*a* of the first upper portion 401*a* (see FIGS. 2 and 3). As illustrated in FIG. 5, the bridge 450, first upper portion 401*a*, and second upper portion 401*b* have a generally uniform thickness in the perpendicular direction with respect to the lengthwise direction of the IDCC header pin 400.

Figure 2:
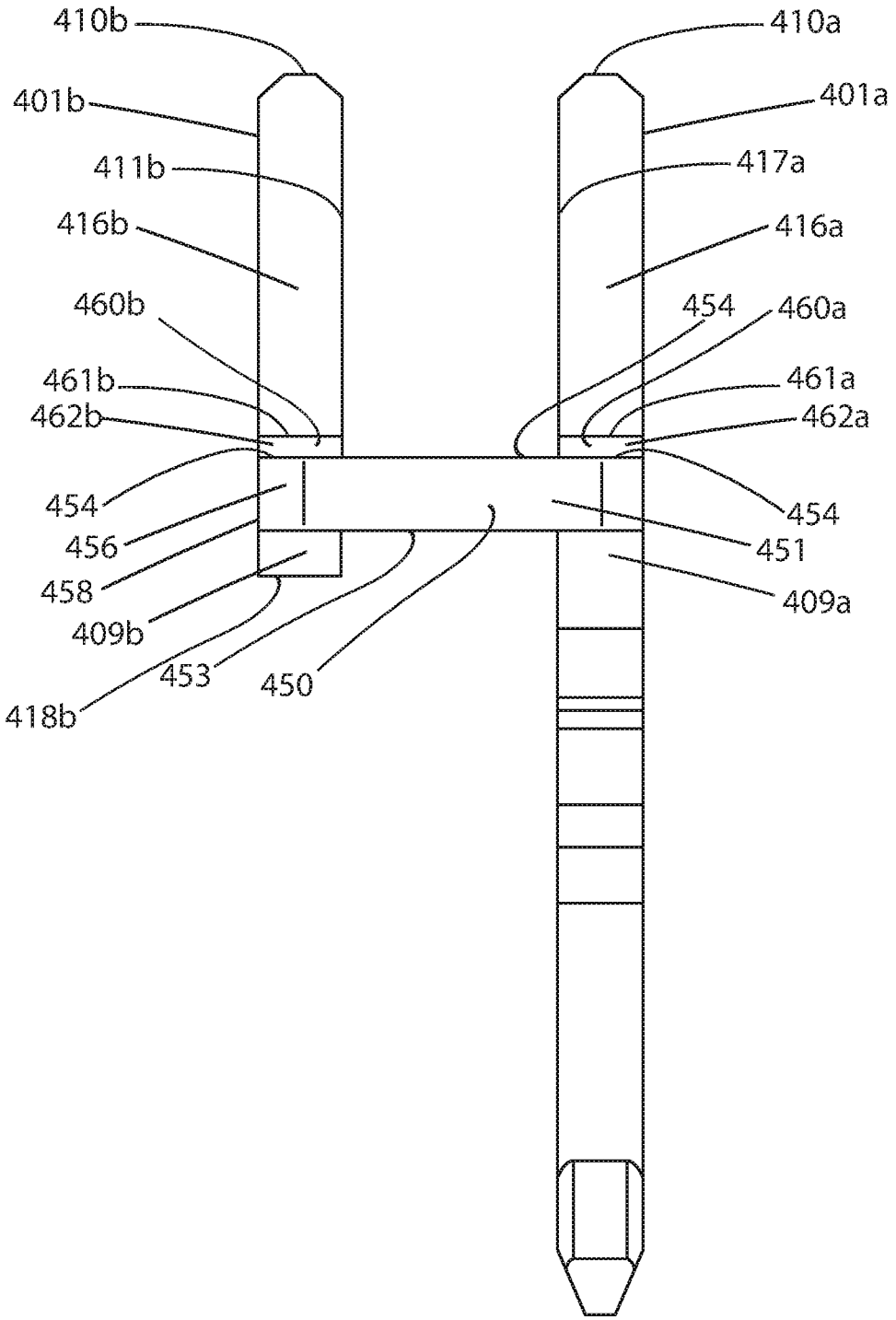
FIG. 2 is a side elevation view of an embodiment of the dual contact bent IDCC header pin of the present invention.
Figure 3:
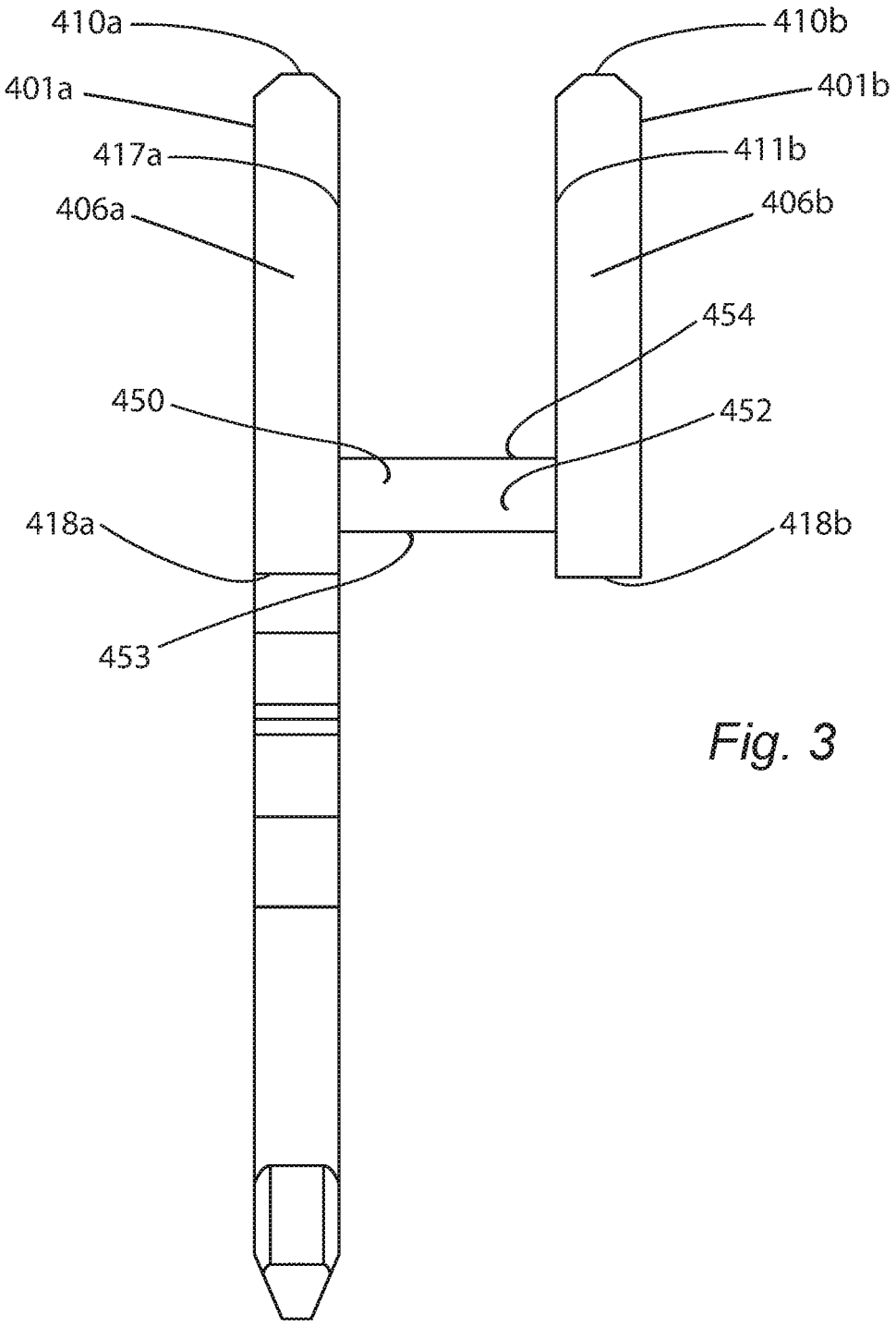
FIG. 3 is a side elevation view of an embodiment of the dual contact bent IDCC header pin of the present invention

As in FIGS. 2 and 3, the first side 451 and second side 452 of the bridge 450 are generally parallel with the lengthwise direction of the pin. As closely illustrated in FIGS. 4 and 5, the first side 451 of the bridge 450 generally protrudes a distance equal to that of the upper first sides 416*a*, 416*b* of either of first and second upper portion 401*a*, 401*b*, in a direction perpendicular to the lengthwise direction of the pin (see FIGS. 1, 2, 4). The lower surface 453 of the bridge 450 protrudes past the lower first sides 409*a*, 409*b* of the first and second upper portion 401*a*, 401*b* respectively (see FIGS. 1 and 4).

The upper first sides 416*a*, 416*b* are separated from the bridge 450 by notches 460*a*, 460*b*, respectively (see FIGS. 1 and 2). The notches 460*a*, 460*b* are comprised of an upper surface 461*a*, 461*b* a back 462*a*, 462*b* and the top surface 454 of the bridge 450. The upper surface 461*a*, 461 *b* of notch 460*a*, 460*b* extends from the upper first side 416*a*, 416*b* to the back 462*a*, 462*b* of the notch 460*a*, 460*b*. The back 462*a*, 462*b* of the notch 460*a*, 460*b* is generally parallel to the lengthwise direction of the pin 400. The upper surface 461*a*, 461*b* of the notch 460*a*, 460*b*, is generally perpendicular to the back 462*a*, 462*b* of the notch 460*a*, 460*b*. The top surface 454 of the bridge 450 is generally perpendicular to the back 462*a*, 462*b* of the notch 460*a*, 460*b*. The bridge 450 has a curved end portion 456 parallel to the lengthwise direction of the dual contact bent IDCC header pin 400 and below the upper surface 461*a*, 461*b* of the notch 460*a*, 460*b* (see FIGS. 1, 2 and 4).

As illustrated in FIG. 1, the lower portion of the first upper portion 410*a*, and second upper portion 410*b* respectively (i.e., in the direction toward tip 440), are forward stops 418*a*, 418*b* which include a flat region perpendicular to the lengthwise direction of the IDCC header pin 400 and facing generally toward tip 440. The lower surface 453 of the bridge 450 is located higher on the pin 400 (i.e. in the direction of IDC flats) than the forward stops 418*a*, 418*b* and faces perpendicular to the lengthwise direction of the IDCC header pin 400 (see FIG. 5). The forward stops 418*a*, 418*b* and lower surface of the bridge 450, function to end forward motion of the IDCC header pin 400 when inserted into a housing, and define the position of the IDCC header pin 400 when fully inserted in a housing.

Figure 4:
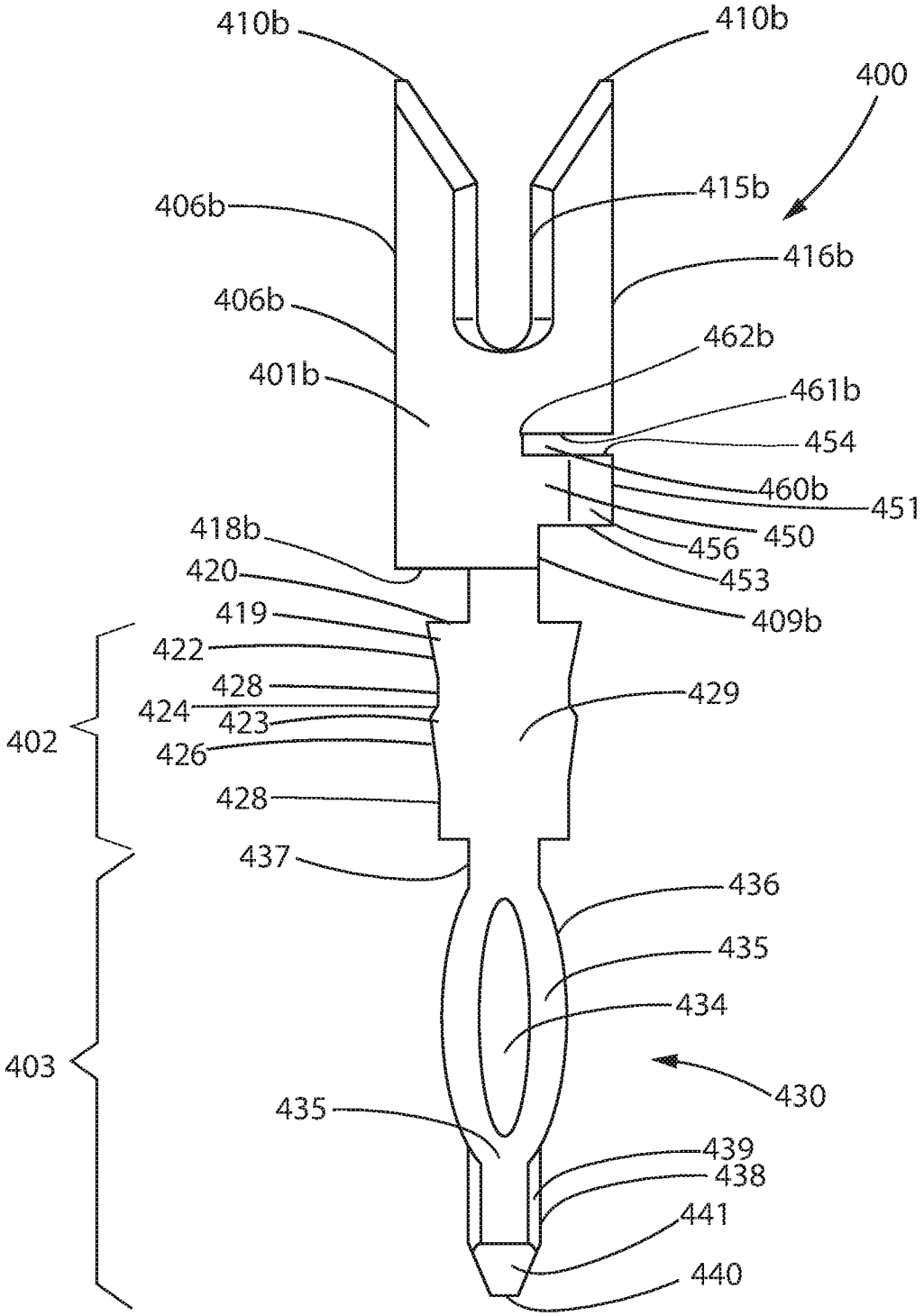
FIG. 4 is a front elevation view of an embodiment of the dual contact bent IDCC header pin of the present invention.

Below the forward stop 418*a*, is pin barb section 402 (see FIGS. 1 and 4). Pin barb section 402 includes a face surface 429 and sides 428. The sides 428 have at least a first pin barb 419. Pin barbs are known in the art and function to anchor and retain the IDCC header pin 400 when inserted into a housing, preventing it from being withdrawn. First pin barb 419, is an angled protrusion which extends outward from side 428 and has a top surface 420 perpendicular to the lengthwise direction of the pin 400. An outward angled side wall 422 leads up to top surface 420. In FIG. 4, first pin barb 419 is present on opposite sides 428 of pin barb section 402 respectively. Below the first pin barb 419 is second pin barb 423, also an angled protrusion which extends outward from side 428 and has a top surface 424. The second pin barb 423 further includes an outward angled side wall 426. A second pin barb 423 is present on opposite sides 428 of pin barb section 402 respectively (see FIG. 1). Second pin barb 423 also serves to anchor and retain the IDCC header pin 400 when inserted into a housing.

As further illustrated in FIG. 1, below the lower end of pin barb section 402, in lower section 403, is compliant retention feature 430, in an eye-of-the-needle design. The compliant retention feature 430 includes oval rounded sides 436 and an inner wall 433 which forms an oval shaped inner hole 434. The oval rounded sides 436 extend outward from sides 437, 438, and 439 of lower section 403. In the center of the compliant retention feature 430 is an oval shaped inner hole 434. The inner hole 434 is formed by an inner wall 433 perpendicular to the face 435 of the lower section 403. The compliant retention feature 430 flexes inward when pressure is applied to the oval rounded sides 436. Compliant retention feature 430 of the IDCC header pin 400 penetrates a respective hole in a PCB when the pin is inserted. The oval rounded sides 436 are compressed and flex inward when inserted into a hole in a PCB, thereby the oval rounded sides 436 provide pressure outward against the inside edges of a hole and create an interference fit.

Embodiment 2

Figure 6:
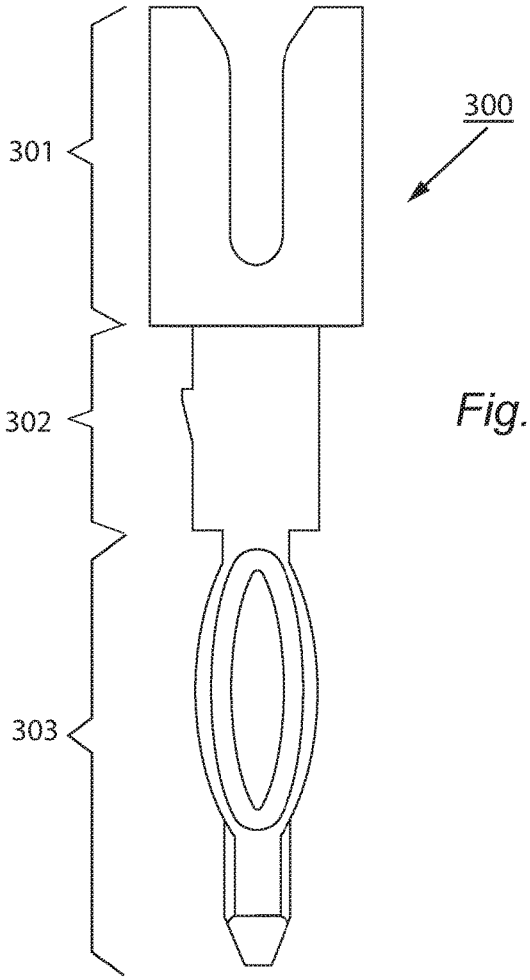
FIG. 6 is a front elevation view of another embodiment of the IDCC header pin of the present invention.
Figure 7:
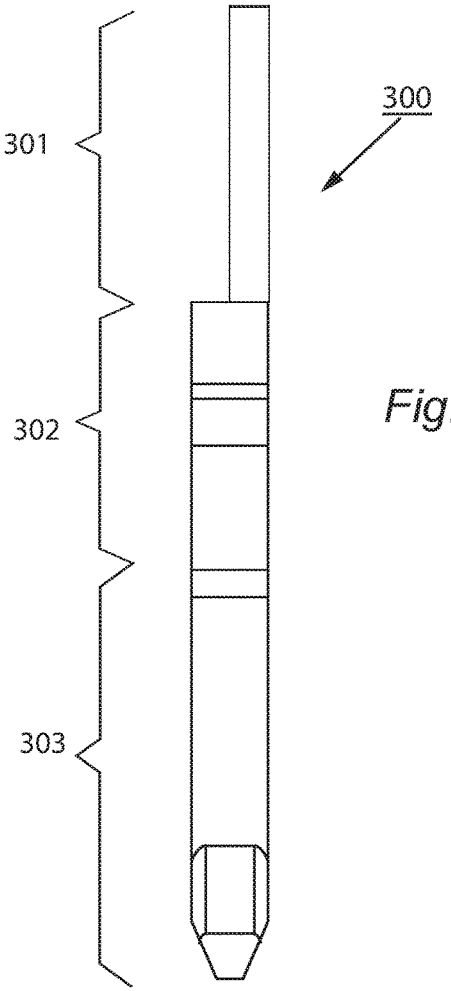
FIG. 7 is a side elevation view of another embodiment of the IDCC header pin of the present invention.
Figure 8:
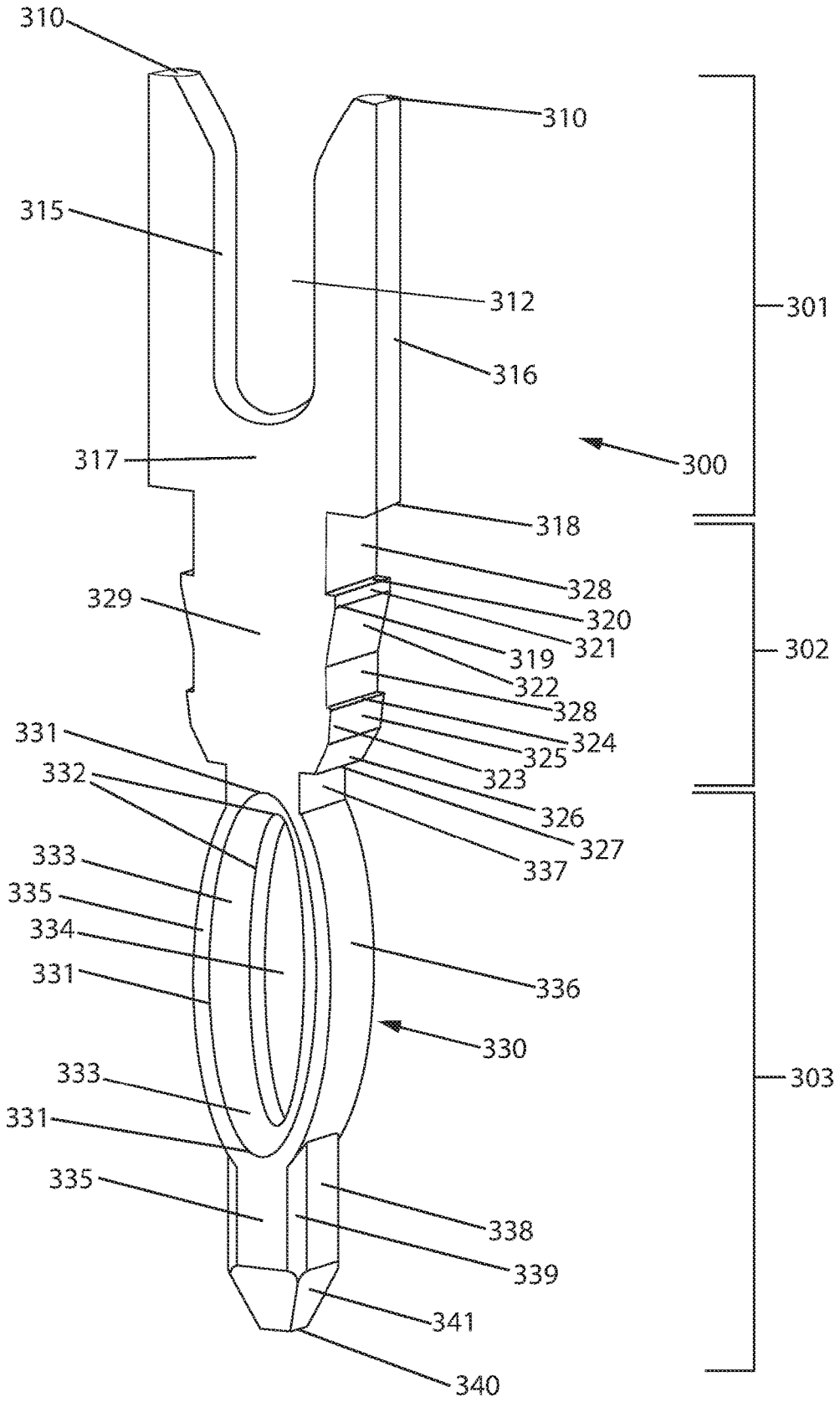
FIG. 8 is a perspective view of another embodiment of the IDCC header pin of the present invention.

FIG. 8 illustrates the two-thickness IDCC header pin 300. As shown in FIG. 8, the IDCC header pin 300 can be considered to have a lengthwise direction and can be considered to have three sections: an upper section 301, a pin barb section 302 and a lower section 303. The IDCC header pin 300 in FIGS. 6 and 7 has two thicknesses in the perpendicular direction with respect to the lengthwise direction of the pin; with the upper section 301 of IDCC header pin 300 having a thickness less than the thickness of the pin barb section 302 and the lower section 303; and with the pin barb section 302 and the lower section 303 having a uniform thickness.

In upper section 301, at one end, in the lengthwise direction of the IDCC header pin 300 is IDC flat 310, which includes two flat regions perpendicular to the lengthwise direction of IDCC header pin 300. The IDCC flat 310 is a surface on which a machine/jig can apply force to the IDCC header pin 300 to insert it into housing 100. Along the side of the lengthwise direction of the upper section 301 are side walls 316. At the opposite end of the IDCC header pin 300 in the lengthwise direction, is IDCC header pin tip 340. The lower section 303 includes pin lead-in chamfers 341, which are angled to prevent stubbing of the header pin 300 when it is inserted into and through a housing or a hole in a printed circuit board.

In upper section 301, below the IDCC flat 310 in FIG. 8 is IDCC blade 315. IDC blades are known in the art and are capable of cutting into the wire jacket of a wire conductor to make non-damaging electrical contact with a wire conductor. IDCC blade 315 is generally of a horseshoe shape with a gap 312 between the blade 315.

Below the IDCC blade 315 in FIG. 8 (i.e., in the direction toward tip 340), in the lower portion of upper section 301, is forward stop 318, which includes two opposite flat regions perpendicular to the lengthwise direction of the IDCC header pin 300 and facing generally toward tip 340. This forward stop 318 functions to end forward motion of the IDCC header pin 300 when inserted into a housing, and defines the position of the IDCC header pin 300 when fully inserted in a housing.

Figure 9A:
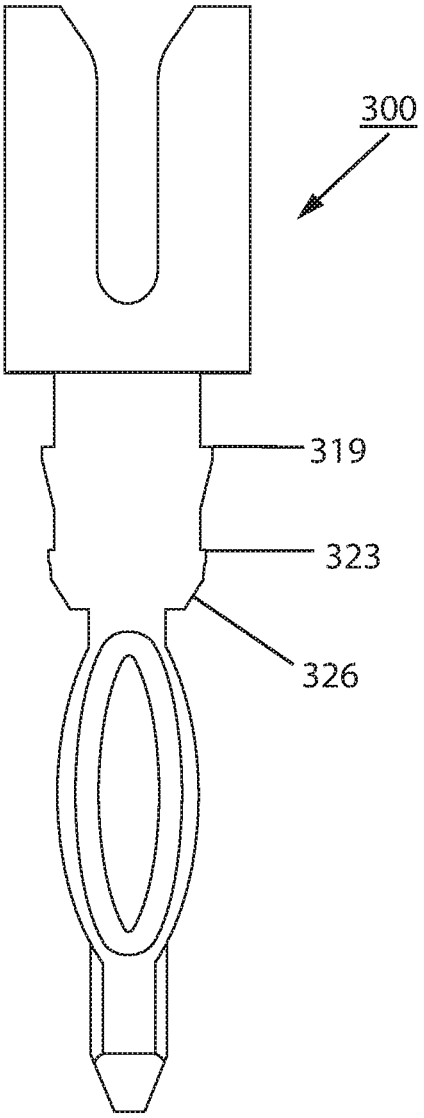
FIGS. 9A, 9B, 9C, 9D, 9E, 9F and 9G are front elevation views of other embodiments of an IDCC header pin of the present invention.
Figure 9B:
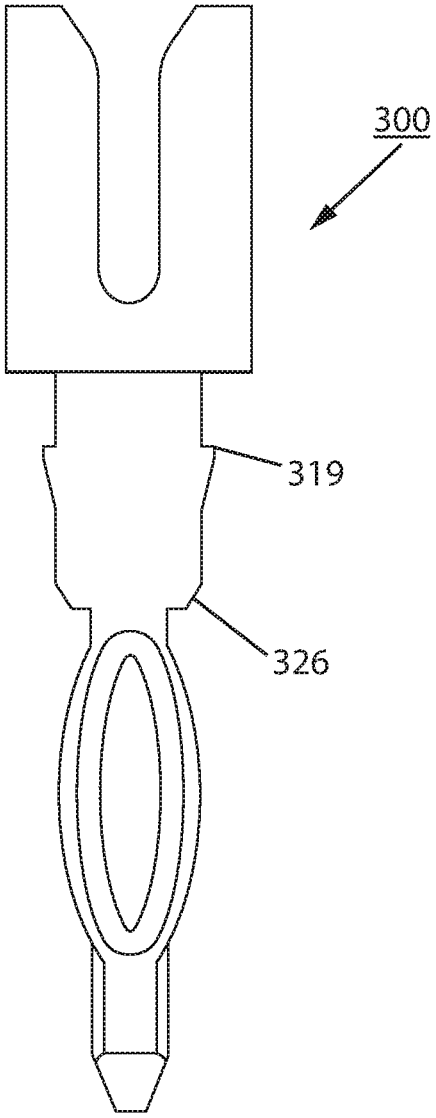
Figure 9C:
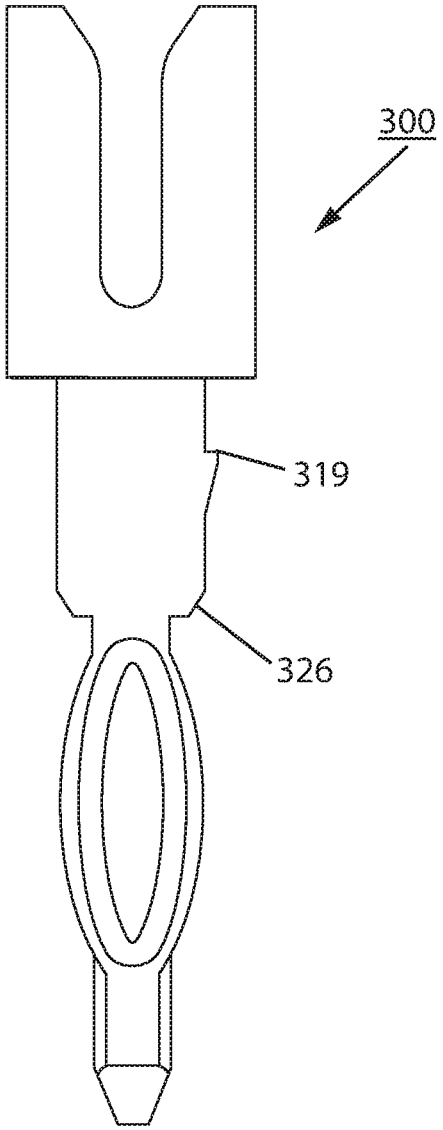

As shown in FIG. 8, below the forward stop 318 is pin barb section 302. Pin barb section 302 includes a face surface 329 and sides 328. The sides 328 have at least a first pin barb 319. Pin barbs are known in the art and function to anchor and retain the IDCC header pin 300 when inserted into a housing, preventing it from being withdrawn. First pin barb 319, is an angled protrusion which extends outward from side 328 and has a top surface 320 perpendicular to the lengthwise direction of the pin 300. The first pin barb 319 further includes a side wall 321 which is generally parallel to the lengthwise direction of the pin 300 and an outward angled side wall 322 leading up to the lower end of side wall 321. In FIG. 8, first pin barb 319 is present on opposite sides 328 of pin barb section 302 respectively. Below the first pin barb 319 is second pin barb 323, also an angled protrusion which extends outward from side 328 and has a top surface 324 perpendicular to the lengthwise direction of the pin 300. The second pin barb 323 further includes a side wall 325 which is generally parallel to the lengthwise direction of the pin 300 and extends from an upper end of an angled barb lead-in chamfer 326 at the bottom of pin barb section 302. In FIG. 8, second pin barb 323 is present on opposite sides 328 of pin barb section 302 respectively. Second pin barb 323 also serves to anchor and retain the IDCC header pin 300 when inserted into a housing. It is possible for the IDCC header pin to have only a single first pin barb (see FIG. 10, 9D) and any additional pin barbs (see FIG. 9A, 9B, 9C, 9E), but generally a pair of first and second pin barbs on opposite sides of the pin barb section 302 will be present (see FIGS. 8, 9A) to provide a sufficient anchoring into a housing.

At the lower end of pin barb section 302, is the barb lead-in chamfer 326, which is an angled wall, angled upward from a bottom surface 327 of pin barb section 302 which is perpendicular to the lengthwise direction of the IDCC header pin 300. The barb lead-in chamfer 326 serves to lead the pin barb section 302 of the IDCC header pin 300 into a housing and thereby prevent stubbing of the IDCC header pin 300 during insertion into a housing. Further, the barb lead-in chamfer is optionally omitted from the pin structure as in FIGS. 9D, 9E, 9F, and 10.

As further illustrated in FIG. 8, below the barb lead-in chamfer 326, in lower section 303, is compliant retention feature 330, in an eye-of-the-needle design. The compliant retention feature 330 includes oval rounded sides 336 and an inner beveled wall 333 which forms an oval shaped inner hole 334. The oval rounded sides 336 extend outward from sides 337, 338, and 339 of lower section 303. In the center of the compliant retention feature 330 is an oval shaped inner hole 334. The inner hole 334 is formed by an inner beveled wall 333 which angles inward from the face 335 of the lower section 303. The surface of the beveled side wall extends from an outer edge 331 to an inner edge 332. The inner edge 332 forms a perimeter around the inner hole 334 in the middle of the compliant retention feature 330. The compliant retention feature flexes inward when pressure is applied to the oval rounded sides 336. Compliant retention feature 330 of the IDCC header pin penetrates a respective hole in a PCB. The oval rounded sides 336 are compressed and flex inward by the inside edge of a hole when inserted into a PCB, thereby the oval rounded sides 336 provide pressure outward against the inside edges of the hole, with an interference fit.

Figure 9D:
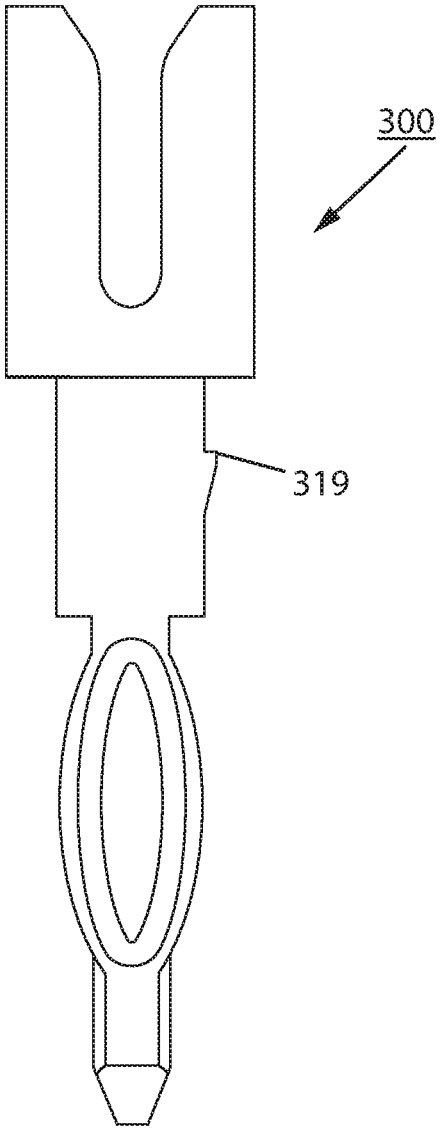
Figure 9E:
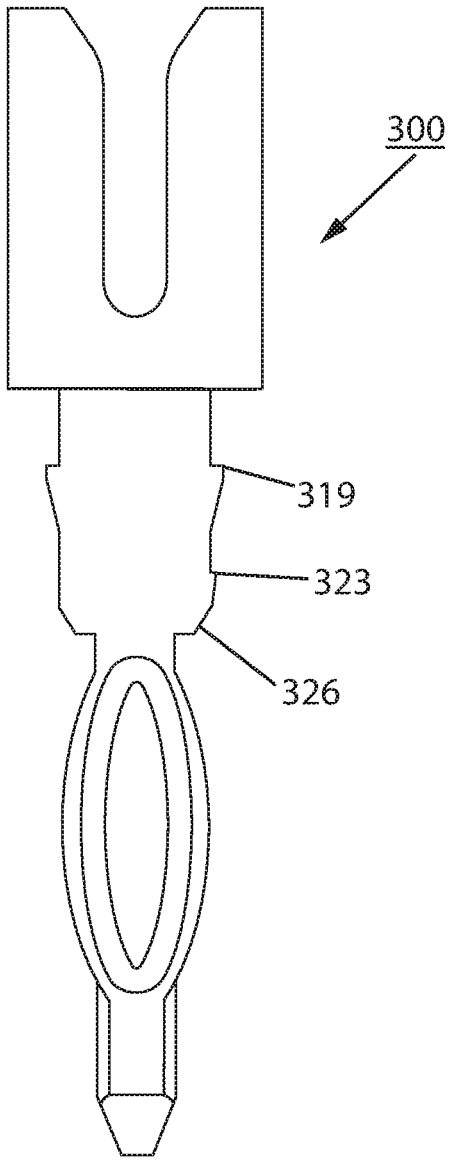
Figure 9F:
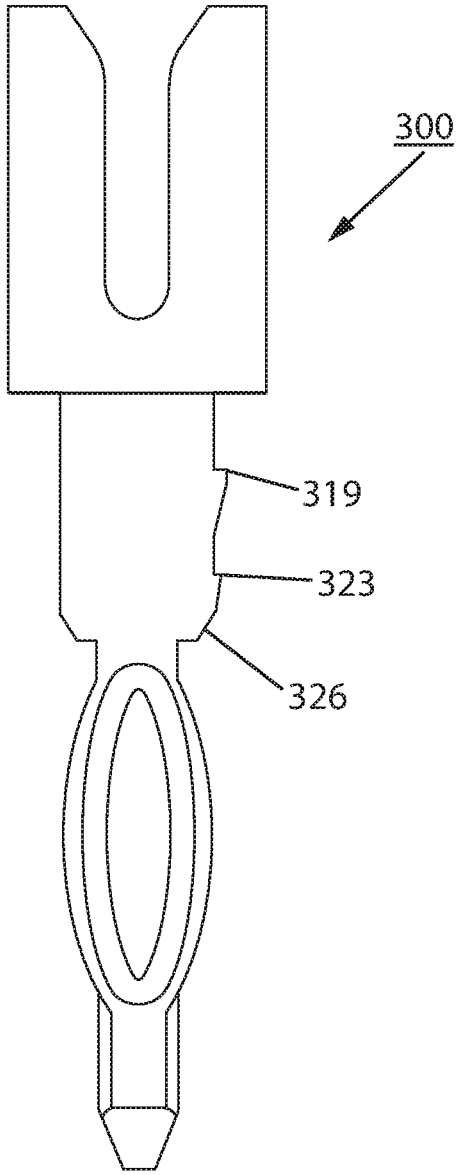
Figure 9G:
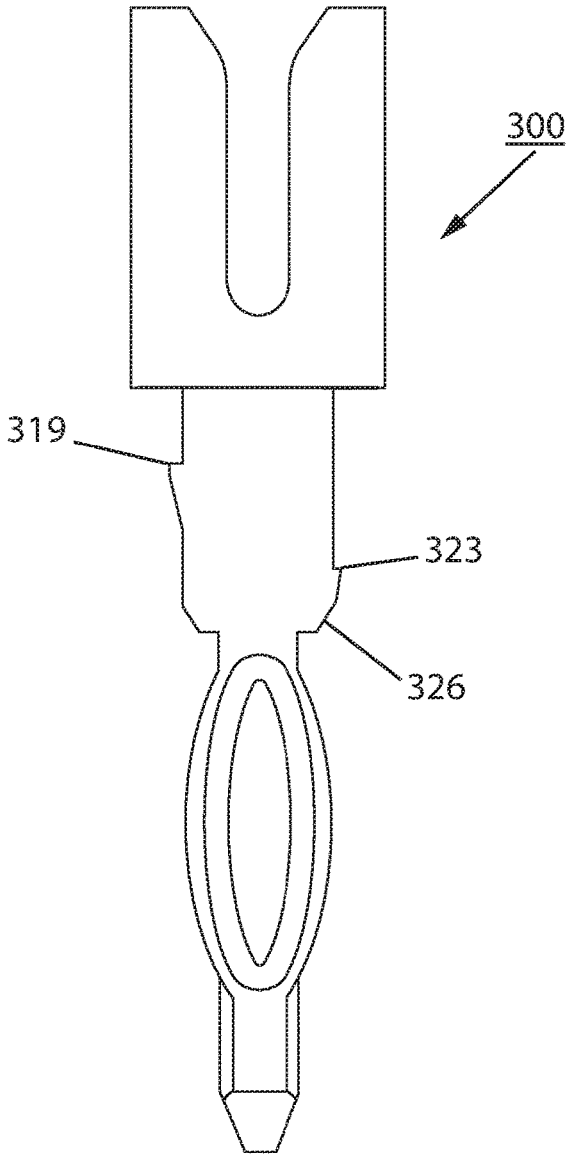
Figure 10:
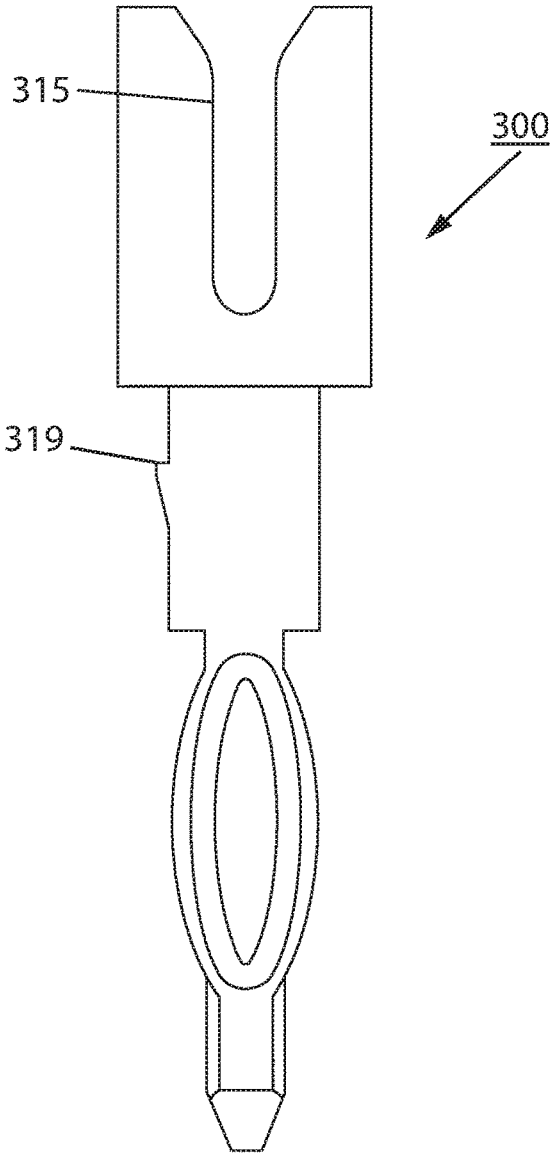
FIG. 10 is a front elevation view of another embodiment of the IDCC header pin of the present invention.

Shown in FIGS. 9A, 9B, 9C, 9D, 9E, 9F, 9G are embodiments of IDCC header pin 300, wherein the pin 300 has at least one of a first pin barb and an arrangement of additional first and second pin barbs as shown. In FIGS. 9D, 10 the pin barb section chamfer is removed. These embodiments are not limited to the combinations shown but allow for a combination of these features.

Accordingly, it is to be understood that the embodiments of the foregoing description herein described are merely illustrative of the application of the principles of the invention. Reference herein to details of the illustrated embodiments is not intended to limit the scope of the claims, which themselves recite those features regarded as essential to the invention. Moreover, features described in connection with one embodiment of the invention may be used in conjunction with other embodiments, even if not explicitly stated above.

LIST OF REFERENCE NUMERALS

300 IDCC header pin
301 Upper Section
302 Pin Barb Section
303 Lower Section
310 IDCC Flat
312 IDCC Blade Gap
313 First Surface of the Upper Section
314 Second Surface of the Upper Section
315 IDCC Blade
316 Side Walls of the Upper Section
317 Face of the Upper Section
318 IDCC Header Pin Forward Stop
319 First Pin Barb of IDCC Header Pin
320 Top Surface of First Pin Barb
321 Side Wall of First Pin Barb

322 Angled Side Wall of First Pin Barb
323 Second Pin Barb of IDCC Header Pin
324 Top Surface of Second Pin Barb
325 Side Wall of Second Pin Barb
326 Barb Lead-in Chamfer
327 Bottom Surface of Pin Barb Section
328 Sides of Pin Barb Section
329 Face Surface of Pin Barb Section
330 Compliant Retention Feature
331 Outer Edge of Compliant Hole
332 Inner Edge of Compliant Hole
333 Inner Beveled Wall of Compliant
334 Inner Hole of Compliant
335 Face of Lower Section
336 Oval Rounded Sides of Compliant
337 Side of Lower Section
338 Side of Lower Section
339 Side of Lower Section
340 IDCC Header Pin Tip
341 IDCC Header Pin Lead-in Chamfers
400 IDCC Header Pin
401*a* First upper section
401*b* Second Upper Section
402 Pin barb section
403 Lower Section
406*a* Second Side
406*b* Second Side
409*a* Lower First Side
409*b* Lower First Side
410*a* IDC Flat
410*b* IDC Flat
411*b* Rear Face of Second Upper Section
412*a* Gap
412*b* Gap
415*a* IDCC Blades
416*a* Upper First Side
416*b* Upper First Side
417*a* Front Face of First Upper Section
418*a* Forward Stop
418*b* Forward Stop
419 First Pin Barb
420 Top Surface of First Pin Barb
422 Side Wall of First Pin Barb
423 Second Pin Barb
424 Top Surface of Second Pin Barb
426 Side Wall of Second Pin Barb
428 Sides of Pin Barb Section
429 Face Surface of Pin Barb Section
430 Compliant Retention Feature
433 Inner Wall of Compliant Retention Feature
434 Inner Hole of Compliant Retention Feature
435 Face of Lower Section
436 Sides of Compliant Retention Feature
437 Side
438 Side
439 Side
440 Header Pin Tip
441 Pin Lead-in Chamfers
450 Bridge
451 First side of the Bridge
452 Second Side of the Bridge
453 Lower Surface of the Bridge
454 Top Surface of the Bridge
456 Curved Portion of Bridge
458 End of the Bridge
460*a* Notch
460*b* Notch
461*a* Upper Surface of Notch
461*b* Upper Surface of Notch
462*a* Back of Notch
462*b* Back of Notch

We claim:

1. An insulation displacement contact compliant pin, comprising:

an upper section having a blade thereon, the upper section having a front face that extends in a predetermined direction, the upper section having a thickness less than the thickness of a pin barb section and a lower section, the pin barbs section having a bottom surface, the pin barbs section having a substantially uniform thickness, the pin barbs section being below a forward stop being a pair of flat regions of the upper section, the pin barbs section having a face surface and sides, and the pin barbs section having a first pin barb thereon extending from the sides, the first pin barb of the pin barbs section having a portion thereof generally, perpendicular to the lengthwise direction of the pin barbs section, the first pin barb having a side wall being generally parallel to the lengthwise direction of the pin barbs section, the portion generally perpendicular to the lengthwise direction meeting the portion generally parallel to the lengthwise direction, and the sides of the pin barb section being below the forward stop of the upper section, and the sides having a portion thereof above the first pin barb; and a lower section with a compliant retention feature, the lower section having a substantially uniform thickness, a front face, oval rounded sides, and at least a side, having one of at least a side above the oval rounded sides, having one of at least a side below the oval rounded sides, having another side between the front face of the lower section and the at least a side below the oval rounded sides, the compliant retention feature of the lower section, its entirety, being below the bottom surface of the pin barbs section and having a direction of compliance that is substantially parallel to the predetermined direction along which the front face of the upper section extends, the lower section having pin lead-in chamfers being angled surfaces, and the lower section having a tip defining an end surface of the insulation displacement contact compliant pin and being generally perpendicular to the lengthwise direction of the lower section, the forward stop of the pin barbs section extending in a direction substantially perpendicular to the lengthwise direction of the pin barbs section, and the forward stop extending further in a direction substantially, perpendicular than the front surface of the pin barbs section, and extending further in a direction substantially perpendicular than the front face of the lower section.

2. The insulation displacement contact compliant pin of claim 1, wherein the pin barbs section comprises a second pin barb thereon.

3. The insulation displacement contact compliant pin of claim 1, wherein the pin barbs section comprises a pair of the first pin barbs on opposite sides of the pin barbs section.

4. The insulation displacement contact compliant pin of claim 1, wherein the pin barbs section comprises one pair of a second pin barb thereon below the first pin barb.

5. The insulation displacement contact compliant pin of claim 3, wherein the pin barbs section comprises a pair of a second pin barb thereon below the pair of first pin barbs.

6. An insulation displacement contact compliant pin, comprising a first upper section having a blade thereon, the upper section having a front face that extends in a predetermined direction, and being generally parallel to the lengthwise direction of the first upper section;

a second upper section having a blade thereon, the second upper section having a front face that extends in a predetermined direction, and being generally parallel to the lengthwise direction of the second upper section, the second upper section being generally parallel with the first upper section, the second upper section having a rear face which faces the front face of the first upper section;

a bridge which connects the first upper section and second upper section, the bridge extending from the front face of the first upper section to the rear face of the second upper section, and extending in a direction substantially perpendicular to the front face of the first upper section, and being generally perpendicular to the rear face of the second upper section, and extending generally perpendicular with respect to the lengthwise direction of the first and second upper sections, a pin barbs section having a bottom surface, the pin barbs section having a substantially uniform thickness, the pin barbs section being below a forward stop being a flat region of the upper section, the pin barbs section having a face surface and sides, the pin barbs section having a first pin barb thereon extending from the sides, and the first pin barb of the pin barbs section having a portion thereof generally perpendicular to the lengthwise direction of the pin barbs section, the first pin barb having a side wall being generally parallel to the lengthwise direction of the pin barbs section, and the sides of the pin barbs section being below the forward stop of the first upper section, and the sides having a portion thereof above the first pin barb; and a lower section with a compliant retention feature, the lower section having a substantially uniform thickness, a front face, oval rounded sides, and having at least a side, having one of at least a side above the oval rounded sides, having one of at least a side below the oval rounded sides, having another side between the front face of the lower section and the at least a side below the oval rounded sides, the compliant retention feature of the lower section, its entirety, being below the bottom surface of the pin barbs section and having a direction of compliance that is substantially parallel to the predetermined direction along which the front face of the upper section extends, the lower section having pin lead-in chamfers being angled surfaces, the lower section having a tip defining an end surface of the insulation displacement contact compliant pin and being generally perpendicular to the lengthwise direction of the lower section, the forward stop of the pin barbs section extending in a direction substantially perpendicular to the lengthwise direction of the pin barbs section, and the forward stop extending further in a direction substantially perpendicular than the front surface of the pin barbs section, and extending further in a direction substantially perpendicular than the front face of the lower section.

7. The insulation displacement contact compliant pin of claim 6, wherein the pin barbs section comprises a second pin barb thereon.

8. The insulation displacement contact compliant pin of claim 6, wherein the pin barbs section comprises a pair of the first pin barbs on opposite sides of the pin barbs section.

9. The insulation displacement contact compliant pin of claim 6, wherein the pin barbs section comprises one pair of a second pin barb thereon below the first pin barb.

10. The insulation displacement contact compliant pin of claim 8, wherein the pin barbs section comprises a pair of a second pin barb thereon below the pair of first pin barbs.

* * * * *